US008285177B2

(12) United States Patent
Iwasaki

(10) Patent No.: US 8,285,177 B2
(45) Date of Patent: Oct. 9, 2012

(54) CHARGING DEVICE AND IMAGE FORMING APPARATUS

(75) Inventor: Jin Iwasaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 232 days.

(21) Appl. No.: 12/872,504

(22) Filed: Aug. 31, 2010

(65) Prior Publication Data

US 2011/0222910 A1 Sep. 15, 2011

(30) Foreign Application Priority Data

Mar. 10, 2010 (JP) ..... 2010-053482

(51) Int. Cl.
*G03G 15/02* (2006.01)

(52) U.S. Cl. ..... 399/176; 399/89

(58) Field of Classification Search ..... 399/88, 399/89, 90, 176

See application file for complete search history.

(56) References Cited

U.S. PATENT DOCUMENTS 6,233,419 B1 * 5/2001 Chigono et al. ..... 399/176
7,903,993 B2 * 3/2011 Sakagawa et al. ..... 399/89

FOREIGN PATENT DOCUMENTS

| | | |
|---|---|---|
| JP | A-6-208281 | 7/1994 |
| JP | A-9-244499 | 9/1997 |
| JP | A-2000-181187 | 6/2000 |
| JP | A-2000-181199 | 6/2000 |

* cited by examiner

*Primary Examiner* — Hoang Ngo
(74) *Attorney, Agent, or Firm* — Oliff & Berridge, PLC

(57) ABSTRACT

A charging device includes a charging roll, a voltage application member and a confronting potential varying unit. The charging roll is disposed so as to be in contact with an image holding body on whose surface an electrostatic latent image is to be formed, and charges the image holding body. The voltage application member is disposed so as to be in contact with the charging roll, and applies a voltage to a surface of the charging roll. The confronting potential varying unit varies a surface potential profile of the charging roll in its axial direction in a contact region between the charging roll and the image holding body according to both the number of image-formed sheets and a wear situation of the image holding body so that a surface potential of the image holding body becomes approximately constant in an axial direction of the image holding body.

11 Claims, 10 Drawing Sheets

CHARGING DEVICE AND IMAGE FORMING APPARATUS

CROSS-REFERENCE TO RELATED APPLICATION

This application is based on and claims priority under 35 USC119 from Japanese Patent Application No. 2010-053482 filed on Mar. 10, 2010.

BACKGROUND

1. Technical Field

The present invention relates to a charging device and an image forming apparatus.

2. Related Art

An image forming apparatus, such as copiers and printers, of the electrophotographic type or the like employs a charging device for charging an image holding body such as a photoreceptor drum in advance to write an electrostatic latent image thereon. To suppress the ozone emission, reduce the apparatus size, lower the cost of a high-voltage power source, and attain other purposes, contact charging type charging devices which are brought into contact with an image holding body have come to be used as charging devices of the above kind in place of non-contact charging devices such as a scorotron.

SUMMARY

According to an aspect of the invention, a charging device includes a charging roll, a voltage application member and a confronting potential varying unit. The charging roll is disposed so as to be in contact with an image holding body on whose surface an electrostatic latent image is to be formed, and charges the image holding body. The voltage application member is disposed so as to be in contact with the charging roll, and applies a voltage to a surface of the charging roll. The confronting potential varying unit varies a surface potential profile of the charging roll in an axial direction of the charging roll in a contact region where the charging roll is in contact with the image holding body. The confronting potential varying unit varies the surface potential profile according to both the number of image-formed sheets and a wear situation of the image holding body so that a surface potential of the image holding body becomes approximately constant in an axial direction of the image holding body.

BRIEF DESCRIPTION OF THE DRAWINGS

Exemplary embodiments of the invention will be described in detail based on the following figures, wherein.

DETAILED DESCRIPTION

Embodiments of the present invention will be hereinafter described with reference to the drawings.

Figure 1:
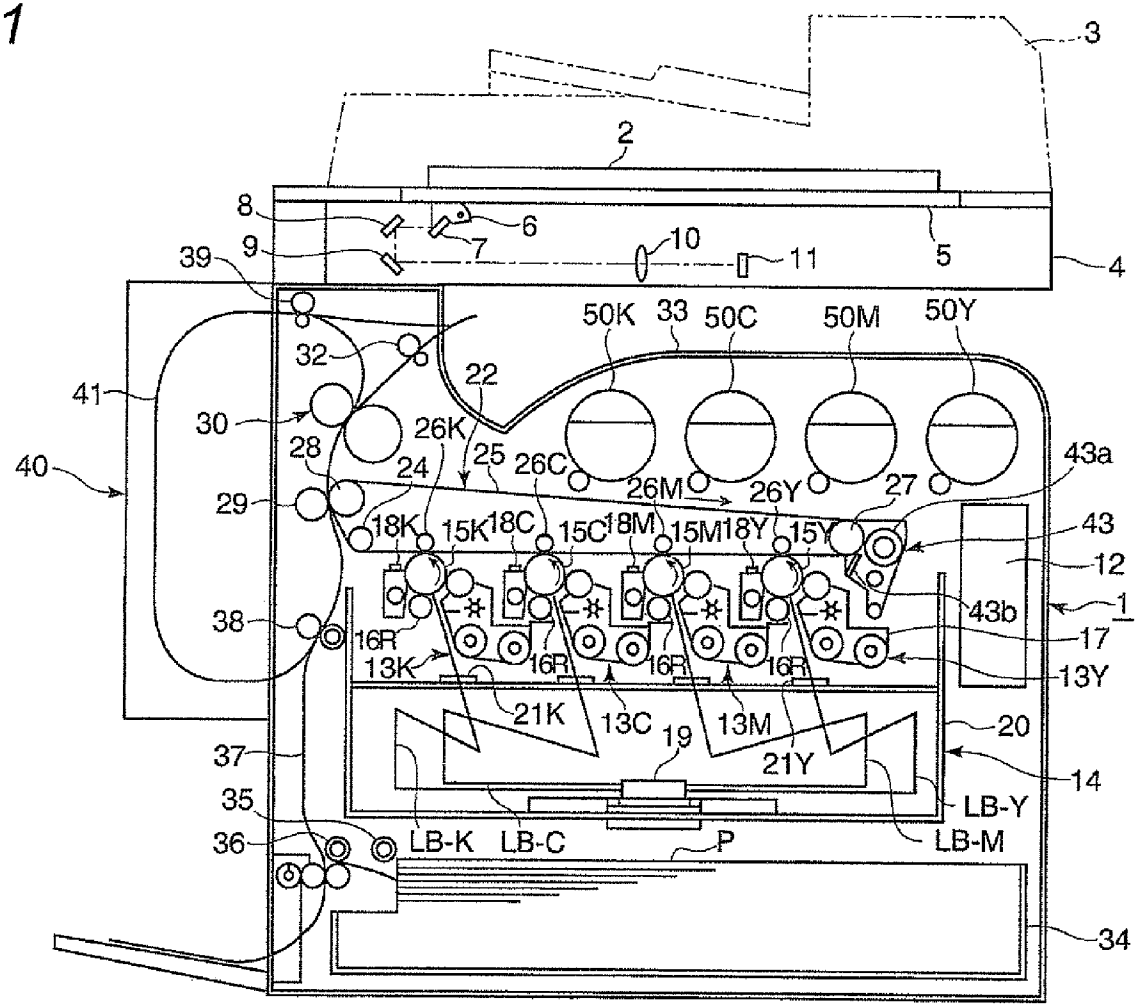
FIG. 1 shows a general configuration of an example image forming apparatus to which the invention can be applied.

First, the configuration of an image forming apparatus to which the invention can be applied will be described with reference to FIG. 1. FIG. 1 shows the configuration of a tandem digital color copier which is an example image forming apparatus to which the invention can be applied. Although this tandem color electrophotographic copier is equipped with an image reading device, the invention can also be applied to a color printer, a facsimile machine, etc. that are not equipped with an image reading device and form an image on the basis of image data that is output from a personal computer or the like (not shown).

In FIG. 1, reference numeral 1 denotes the main body of the tandem digital color copier. An automatic document feeder 3 which automatically conveys document pages 2 separately (one by one) and a document reading device 4 which reads the image of a document page 2 that has been conveyed by the automatic document feeder 3 are disposed over the main body 1. In the document reading device 4, a document page 2 that is placed on a platen glass is illuminated by a light source 6 and a reflection light image coming from the document page 2 shines on an image reading device 11 such as a CCD via a reduction optical system consisting of a full-rate mirror 7, half-rate mirrors 8 and 9, and an image forming lens 10. A colorant reflection light image of the document page 2 is read at a predetermined dot density (e.g., 16 dots/mm) by the image reading device 11 through scanning.

Document reflectivity data of three colors (e.g., red (R), green (G), and blue (B); 8 bits for each color) that are produced by reading the colorant reflection light image of the document page 2 by the document reading device 4 are supplied to an image processing device 12. In the image processing device 12, the reflectivity data of the document page 2 are subjected to image processing such as shading correction, positional deviation correction, lightness/color space conversion, gamma correction, frame removal, and color/movement edit. The image processing device 12 also performs predetermined image processing on image data that are sent from a personal computer or the like.

In the image processing device 12, after being subjected to the predetermined image processing, the image data are converted into document reproduction colorant gradation data of four colors (e.g., yellow (Y), magenta (M), cyan (C), and black (K); 8 bits for each color), which are supplied to an exposing device 14 which consists of image forming units 13Y, 13M, 13C, and 13K of the respective colors (Y, M, C, and K). In the exposing device 14, image exposure is performed using laser beams LB according to the document reproduction colorant gradation data of the four colors, respectively (described later).

The four image forming units 13Y, 13M, 13C, and 13K of Y, M, C, and K are disposed inside the tandem digital color copier main body 1 so as to be arranged in line in the horizontal direction at constant intervals.

The four image forming units 13Y, 13M, 13C, and 13K have the same configuration; each of them is generally composed of a photoreceptor drum 15 as an image holding body which is rotationally driven at a predetermined speed, a charging device 16 for primary charging which charges the surface of the photoreceptor drum 15 uniformly, an exposing device 14 which is a scanning optical system for forming an electrostatic latent image of the color concerned on the surface of the photoreceptor drum 15 by exposing its surface to light, a developing device 17 for developing the electrostatic latent image formed on the photoreceptor drum 15 with a toner of the color concerned, a drum cleaning device 18 for cleaning the surface of the photoreceptor drum 15, and other components.

The exposing device 14, which is shared by the image forming units 13Y, 13M, 13C, and 13K of the respective colors (Y, M, C, and K), is configured in such a manner that four semiconductor lasers (not shown) are modulated according to document reproduction colorant gradation data of the respective colors and thereby emit laser beams LB-Y, LB-M, LB-C, and LB-K according to the gradation data. Alternatively, four exposing device 14 may be provided for the respective image forming units 13Y, 13M, 13C, and 13K. The laser beams LB-Y, LB-M, LB-C, and LB-K emitted from the semiconductor lasers shine on a rotary polygon mirror 19 via f-θ lenses (not shown) and are deflected for scanning by the rotary polygon mirror 19. Each of the laser beams LB-Y, LB-M, LB-C, and LB-K deflected for scanning by the rotary polygon mirror 19 shines on the photoreceptor drum 15 from obliquely below via plural reflection mirrors (not shown) to expose the photoreceptor drum 15 while scanning it.

The exposing device 14 according to the embodiment is enclosed airtight by a rectangular-parallelepiped-shaped frame 20. To apply four laser beams LB-Y, LB-M, LB-C, and LB-K to the photoreceptor drums 15Y, 15M, 15C, and 15K of the image forming units 13Y, 13M, 13C, and 13K, transparent glass windows 21Y, 21M, 21C, and 21K as shield members are provided on the top surface of the frame 20. In the exposing device 14, the glass windows 21Y, 21M, 21C, and 21K are members that are located at the highest positions in the optical paths of the laser beams LB.

The photoreceptor drum 15 is configured in such a manner that functional layers (photoreceptor layers) such as a charge generation layer and a charge transport layer are laid on the surface (outer circumferential surface) of a conductive metal cylinder. And the photoreceptor drum 15 is rotationally driven at a prescribed speed in the direction indicated by the arrow (in this example, counterclockwise in FIG. 1) by a driving means (not shown).

According to each embodiment, the charging device 16 is what is called a contact charging device in which a charging roll 16R which is provided inside a casing (not shown) is brought into contact with and charges the surface of the photoreceptor drum 15 to a predetermined potential. According to each embodiment, the charging roll 16A is brought into pressure contact with the photoreceptor drum 15 by a predetermined pressure contact force that is produced by elastic members such as springs (not shown) that are disposed at the two ends in the axial direction.

Toner cartridges 50Y, 50M, 50C, and 50K for supplying developers (each of which is mainly composed of a toner or is a toner containing a carrier) of predetermined colors to the developing devices 17Y, 17M, 17C, and 17K of the respective colors (Y, M, C, and K) are provided above an intermediate transfer belt 25.

In the four image forming units 13Y, 13M, 13C, and 13K, toner images of Y, M, C, and K are formed sequentially with predetermined timing. As described above, the image forming units 13Y, 13M, 13C, and 13K of the respective colors are provided with the respective photoreceptor drums 15Y, 15M, 15C, and 15K and the surfaces of the photoreceptor drums 15Y, 15M, 15C, and 15K are charged uniformly by the charging devices 16Y, 16M, 16C, and 16K for primary charging, respectively. Then, the surfaces of the photoreceptor drums 15Y, 15M, 15C, and 15K are scan-exposed to image forming laser beams LB-Y, LB-M, LB-C, and LB-K that are emitted from the exposing device 14 according to image data, whereby electrostatic latent images of the respective colors are formed. Settings are made so that the laser beams LB-Y, LB-M, LB-C, and LB-K for scan-exposing of the photoreceptor drums 15Y, 15M, 15C, and 15K are applied to the photoreceptor drums 15Y, 15M, 15C, and 15K at predetermined inclination angles from obliquely below (from bottom-right positions in FIG. 1). The electrostatic latent images formed on the photoreceptor drums 15Y, 15M, 15C, and 15K are developed into visible toner images of the respective colors (Y, M, C, and K) by the developing devices 17Y, 17M, 17C, and 17K of the image forming units 13Y, 13M, 13C, and 13K, respectively.

The toner images of the respective colors (Y, M, C, and K) that have been formed sequentially on the photoreceptor drums 15Y, 15M, 15C, and 15K of the image forming units 13Y, 13M, 13C, and 13K are transferred, sequentially, in superimposition, onto the intermediate transfer belt 25 which is located over the image forming units 13Y, 13M, 13C, and 13K by primary transfer rolls 26Y, 26M, 26C, and 26K. The intermediate transfer belt 25 is wound on a drive roll 27 and a backup roll 28 so as to stretch between them with prescribed tension, and is driven so as to circulate at a predetermined speed in the direction indicated by the arrow by the drive roll 27 which is rotationally driven by a dedicated drive motor (not shown) which is superior in constant speed drive performance. For example, the intermediate transfer belt 25 is an endless belt that is produced by shaping flexible synthetic resin film of PET or the like into a band shape and connecting the two ends of the band-shaped synthetic resin film by welding or a line means.

The toner images of the respective colors (Y, M, C, and K) that have been transferred to the intermediate transfer belt 25 in superimposition are secondarily transferred to a recording sheet P by pressure contact force and electrostatic force that are produced by a secondary transfer roll 29 which is brought into pressure contact with the backup roll 28. The recording sheet P to which the toner images of the respective colors have been transferred is conveyed to a fusing device 30 which is located above the secondary transfer position. Disposed beside the backup roll 28 and brought into pressure contact with it, the secondary transfer roll 29 secondarily transfers the toner images of the respective colors to a recording sheet P being conveyed upward. The recording sheet P to which the toner images of the respective colors have been transferred is subjected to heat/pressure fusing by the fusing device 30, and then ejected by an ejection roll 32 onto an ejected sheet tray 33 which is a top portion of the main body 1.

A recording sheet P having a predetermined size is picked up from a sheet supply cassette 34 by a sheet supply roller 35 and separated by a pair of sheet separation/conveying rollers 36. Then, the recording sheet P is conveyed by the rollers 36 to a registration roll 38 along a sheet conveyance path 37 and stopped there. Then, the recording sheet P is sent out to the secondary transfer position of the intermediate transfer belt 25 by the registration roll 38 when it is rotated with predetermined timing.

In the above digital color copier, in performing double-sided copying in full color, for example, a recording sheet P on whose one surface an image is fused is not ejected onto the ejected sheet tray 33 by the ejection roll 32 and, instead, conveyed to a double-sided copying conveying unit 40 via a pair of sheet conveying rollers 39 after the conveyance direction is switched by a switching gate (not shown). In the double-sided copying conveying unit 40, the recording sheet P is flipped by pairs of conveying rollers (not shown) disposed along a conveyance path 41 and is returned to the registration roll 38. An image is transferred to and fused on the other surface of the recording sheet P, and the recording sheet P is ejected onto the ejected sheet tray 33.

After completion of the toner image transfer step, residual toner, sheet powder, etc. are removed from the surfaces of the photoreceptor drums 15Y, 15M, 15C, and 15K by drum cleaning devices 18Y, 18M, 18C, and 18K to prepare for the next image forming process.

After completion of the toner image transfer step, residual toner, sheet powder, etc. are removed from the intermediate transfer belt 25 by a belt cleaning device 43 to prepare for the next image forming process. The belt cleaning device 43 removes residual toner, sheet powder, etc. from the intermediate transfer belt 25 using a cleaning brush 43*a* and a cleaning blade 43*b* provided therein.

Incidentally, in general, the wear situation (profile) (surface film thickness reduction situation (profile)) of the photoreceptor drum 15 in its axial direction varies over time due to influences of the contact members such as the charging roll 16R which are brought into contact with the surface of the photoreceptor drum 15.

For example, usually, a predetermined pressure contact force is secured for each of the contact members, such as the drum cleaning device 18 and the charging roll 16R, that are brought into contact with the surface of the photoreceptor drum 15 by providing elastic members such as springs or fixing members such as screws at the two ends in the axial direction and pressing the contact member against the photoreceptor drum 15 by means of the elastic members or the like. Therefore, there is a tendency that the photoreceptor drum 15 wears (the surface film thickness is reduced) more over time in both end regions where the pressure contact force is exerted directly than in the other region.

That is, it is unavoidable that there occur a region (hereinafter referred to as a steady wear region; in this example, the region other than both end regions, that is, a central region) Rc where the surface film thickness (i.e., the thickness of the photoreceptor layer) of the photoreceptor drum 15 is reduced steadily due to wear (i.e., approximately at a constant rate) as images are formed repeatedly and local regions where the film thickness is reduced more over time than in the steady wear region due to accelerated wear (hereinafter referred to as accelerated wear regions; in this example, both end regions in the axial direction) Re. As the film thickness is reduced, the amount of discharge that occurs in charging the photoreceptor drum 15 with the charging device 16 is increased and the discharge-induced stress on the surface of the photoreceptor drum 15 is also increased. This renders the surface of the photoreceptor drum 15 further prone to wear and accelerates the wear in the accelerated wear regions (the film thickness reduction is accelerated there). As a result, a high degree of film thickness unevenness is caused in the axial direction. A study of the inventor has revealed that in direct-current voltage application type contact charging devices a surface potential variation (potential unevenness) occurs in the photoreceptor drum 15 in its axial direction to become a factor of causing image defects such as density unevenness.

In the invention, in view of the presence of the above-described accelerated wear regions in the photoreceptor drum 15, the charging device 16 is provided with a confronting potential varying unit (described below) for varying the surface potential of the confronting (corresponding) portion of the charging roll 16R according to the number of image-formed sheets.

Figure 2:
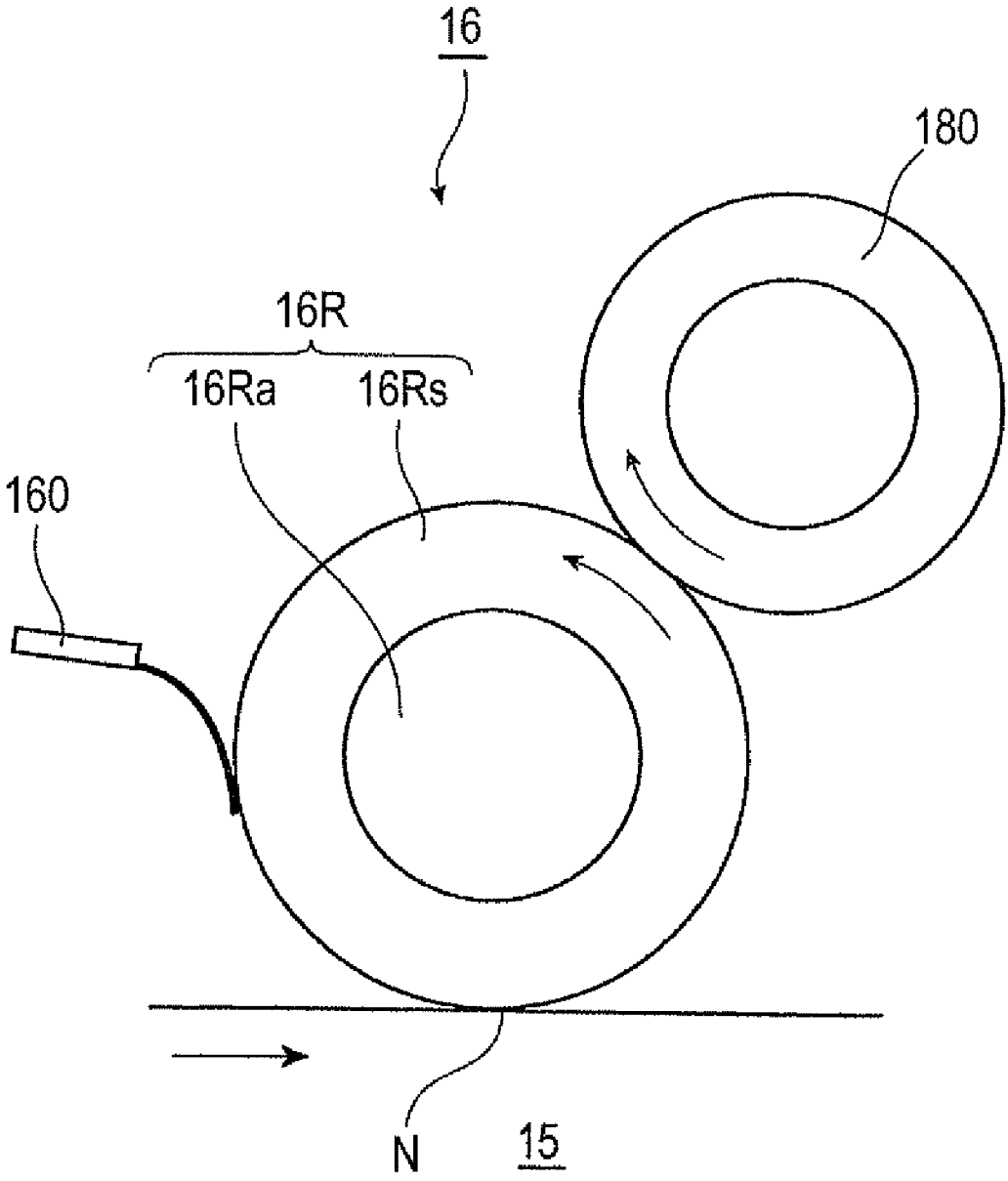
FIG. 2 is a schematic diagram showing the configuration of a charging device according to a first embodiment.

The configuration of a charging device according to a first embodiment of the invention will be described hereinafter with reference to the drawings. FIG. 2 is a schematic diagram showing the configuration of a charging device 16 according to the first embodiment. Since all of the charging devices 16Y, 16M, 16C, and 16K of the image forming units 13Y, 13M, 13C, and 13K have the same configuration, for the sake of simplicity, each set of devices or components will be denoted in a generic manner (like "charging device 16").

As shown in FIG. 2, the charging device 16 according to the first embodiment is equipped with a charging roll 16R which is disposed so as to be in contact with the surface of the photoreceptor drum 15, a voltage application brush 160 as a voltage application member for applying a predetermined direct-current voltage to the charging roll 16R, and a roll cleaner 180 which is disposed upstream of the voltage application brush 160 (in the rotation direction of the charging roll 16R) so as to be in contact with the surface of the charging roll 16R.

In the embodiment, each of the charging roll 16R and the roll cleaner 180 is rotated by the photoreceptor drum 15 (i.e., makes follower or idler rotation).

In the embodiment, the charging roll 16R extends parallel with the axial direction of the photoreceptor drum 15 and is configured in such a manner that a semiconductive surface layer 16Rs is formed around a rotatable support shaft 16Ra. The photoreceptor drum 15 is charged to a prescribed potential by causing a discharge in a very small air gap that is formed in a nip region N and its vicinity by applying a voltage to the surface layer 16Rs (the charging roll 16R is in contact with the photoreceptor drum 15 in the nip region N).

Figure 3:
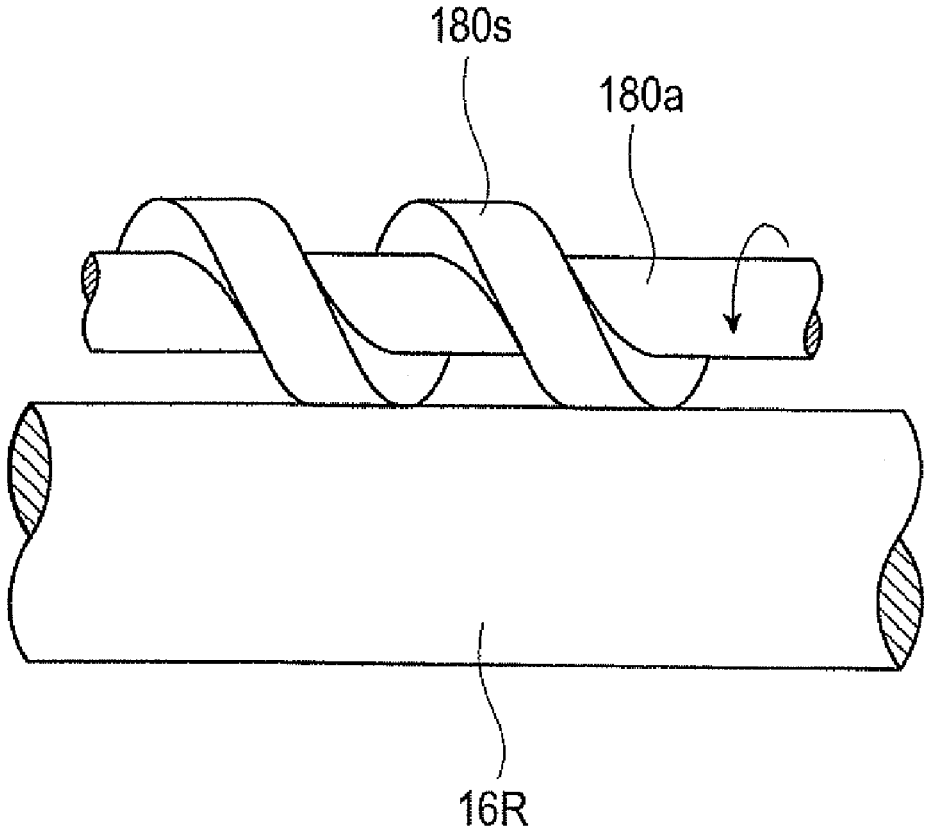
FIG. 3 is a schematic diagram showing the configuration of a roll cleaner according to the first embodiment.

As schematically shown in FIG. 3, the roll cleaner 180 according to the embodiment extends parallel with the axial direction of the charging roll 16R and is configured in such a manner that an elastic member 180*s* such as a sponge which serves as a cleaning member is wound spirally around the surface of a rotatable support shaft 180*a*. The use of the spiral cleaning member 180*a* makes it possible to remove stain that is stuck to the surface of the charging roll 16R while moving (dispersing) it in the axial direction (i.e., without concentrating it locally) and to thereby increase the cleaning performance.

However, the spiral cleaning member 180*s* may become a cause of charging unevenness by friction-charging the charging roll 16R spirally. It is therefore preferable to dispose the roll cleaner 180 upstream of the voltage application brush 160 in the rotation direction of the charging roll 16R.

Figure 4:
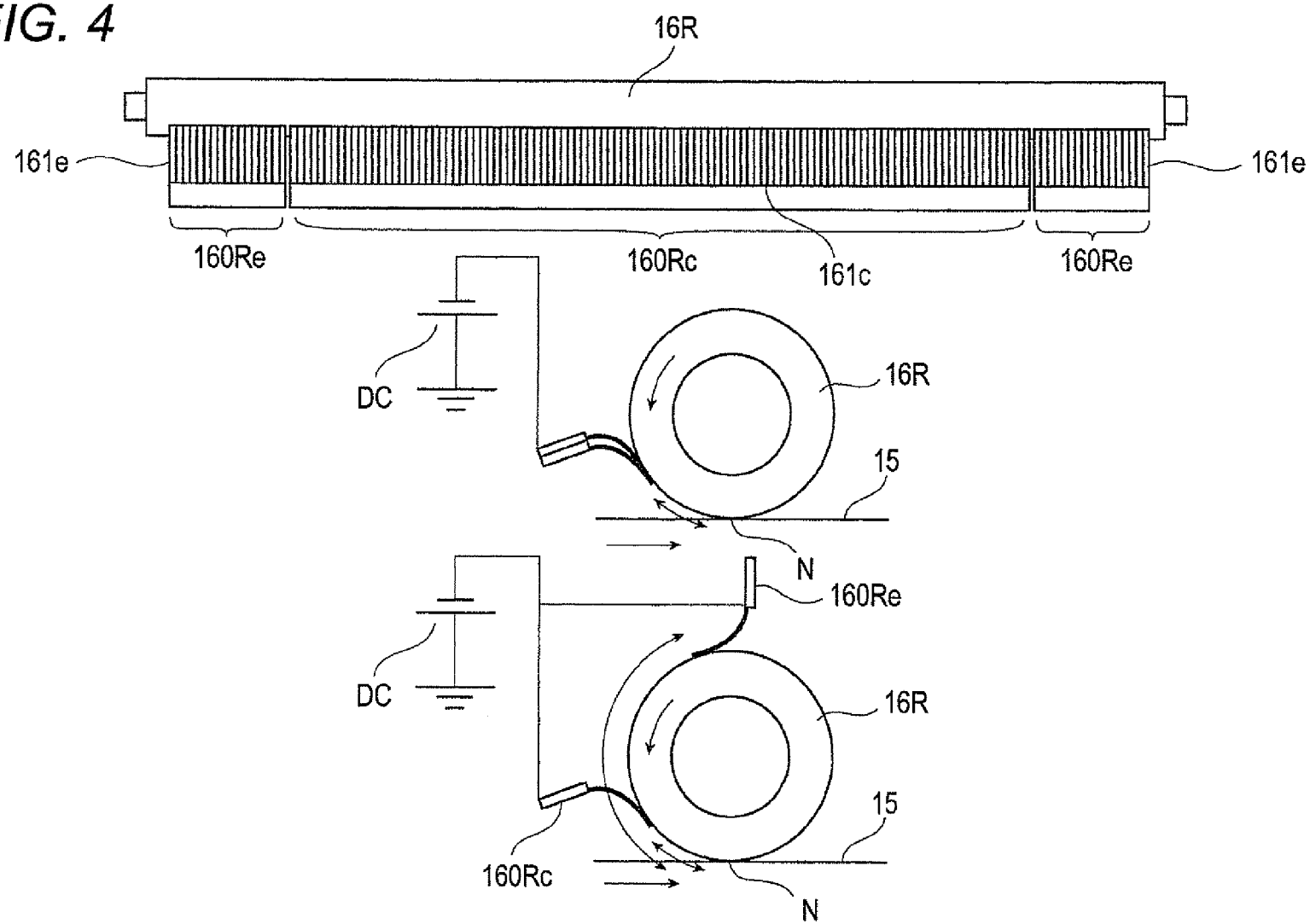
FIG. 4 is a schematic diagram showing a detailed configuration and an operation of the charging device according to the first embodiment.

In the embodiment, as most appropriately shown in FIG. 4, the voltage application brush 160 is a brush member which is connected to a single direct-current voltage source direct-current and has, as a tip portion, conductive brush hair 161 to be brought into contact with the surface of the charging roll 16R. The voltage application brush 160 is divided, in the axial direction, into a central brush portion (steady wear region voltage application portion) 160Rc to apply a voltage to the surface of that portion of the charging roll 16R which corresponds to the steady wear region Rc of the photoreceptor drum 15 and both end brush portions (accelerated wear region voltage application portions) 160Re to apply a voltage to the surfaces of those portions of the charging roll 16R which correspond to the accelerated wear regions Re of the photoreceptor drum 15. Furthermore, whereas the central brush portion (steady wear region voltage application portion) 160Rc is a fixed brush portion whose position with respect to the charging roll 16R is fixed, the both end brush portions (accelerated wear region voltage application portions) 160Re are movable brush portions which can be moved on the surface of the charging roll 16R. A confronting potential varying unit according to the embodiment is realized by moving the movable brush portions 160Re on the circumferential surface of the charging roll 16R while keeping the former in contact with the latter according to the number of image-formed sheets.

Figure 5A:
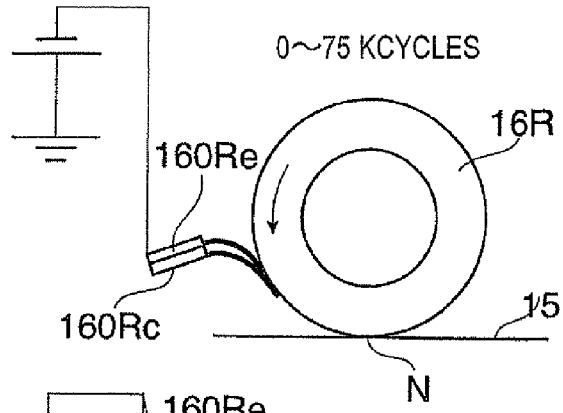
FIGS. 5A-5D are schematic diagrams showing an operation of the charging device according to the first embodiment.

In the above-configured charging device 16 according to the embodiment, as schematically shown in FIG. 5A, in the initial state the central brush portion 160Rc and the both end brush portions 160Re are disposed near the nip region N where the charging roll 16R is in contact with the photoreceptor drum 15. In this state, the distance (across the surface of the charging roll 16R) between the central brush portion 160Rc and the nip region N is the same as that between the both end brush portions 160Rc and the nip region N. Therefore, in the nip region N and its vicinity, the surface potential of the central portion (corresponding to the steady wear region Rc) of the charging roll 16R is the same as that of both its end regions (corresponding to the accelerated wear regions Re).

Figure 5B:
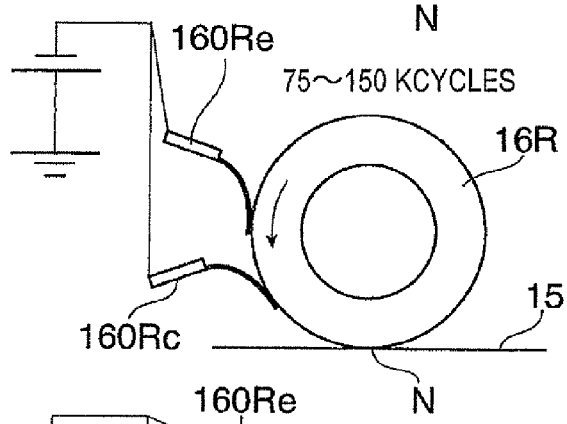
Figure 5C:
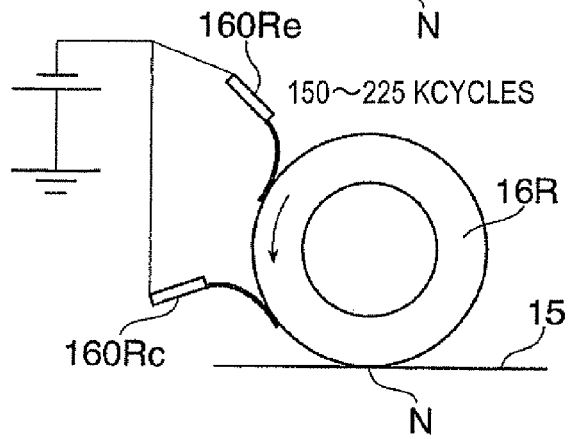
Figure 5D:
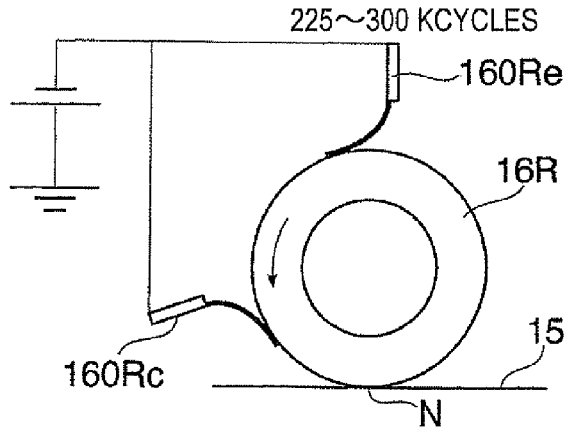

As the number of image-formed sheets increases and the photoreceptor layer of the photoreceptor drum 15 wears (i.e., its surface film thickness is reduced) over time, as schematically shown in FIGS. 5B-5D, the both end brush portions (movable brush portions) 160Re which correspond to the accelerated wear regions Re are moved upstream in the rotation direction of the charging roll 16R. More specifically, as the number of image-formed sheets increases, the both end brush portions 160Re which are part of the confronting potential varying unit are moved away from the nip region N. In this state, the distance (across the surface of the charging roll 16R) between the both end brush portions 160Re and the nip region N is longer than that between the central brush portion 160Rc and the nip region N. Therefore, the voltage applied to the nip region N and its vicinity by the both end brush portions 160Re is given a large voltage drop, whereby the nip region surface potential of both end portions (corresponding to the accelerated wear regions Re) of the charging roll 16R is lower than that of the central portion (corresponding to the steady wear region Rc). That is, as the both end brush portions 160Re go away from the nip region N and its vicinity where the charging roll 16R is in contact with the photoreceptor drum 15 (i.e., as the distance (across the circumferential surface of the charging roll 16R) between the nip region N and the contact portion between the both end brush portions 160Re and the charging roll 16R increases), the surface potential of the charging roll 16R in the nip region N is lowered due to a voltage drop.

On the other hand, since the film thickness (the thickness of the photoreceptor layer) of the photoreceptor drum 15 in the accelerated wear regions (in the example being discussed, both end regions) Re is smaller than that in the steady wear region Rc, the ratio of the film thickness to the length of the very small air gap in the nip region N and its vicinity varies in the axial direction and the electric field developing in the air gap is stronger in both end regions Re. However, the both end brush portions 160Re are moved away from the nip region N so that the nip region surface potential of the corresponding portions of the charging roll 16R is lowered so as to compensate for the electric field strengthening. As a result, an electric field having approximately the same strength as in the steady wear region (in the example being discussed, central region) Rc is formed in the accelerated wear regions Re.

Conventionally, as for the electric field strengthening due to steady wear, the surface potential of the photoreceptor drum 15 in the steady wear region Rc is kept approximately constant by gradually lowering, over time, the power source voltage applied to the voltage application member 160. In the charging device 16 according to the embodiment, in addition to keeping the surface potential of the photoreceptor drum 15 in the steady wear region Rc approximately constant by gradually lowering the power source voltage as the number of image-formed sheets increases, the confronting potential varying unit makes the nip region surface potential of the portions, opposed to (corresponding to) the accelerated wear regions Re, of the charging roll 16R lower than that of the portions, opposed to (corresponding to) the steady wear region Rc, of the charging roll 16R, whereby a surface potential variation (potential unevenness) of the photoreceptor drum 15 in its axial direction can be prevented stably over time.

Although in the embodiment the both end brush portions 160Re serve as movable brush portions, the invention is not limited to such a case. It suffices that a movable brush portion(s) be provided so as to prevent a surface potential variation of the photoreceptor drum 15 in its axial direction according to the number of image-formed sheets taking a wear situation into consideration.

Figure 6A:
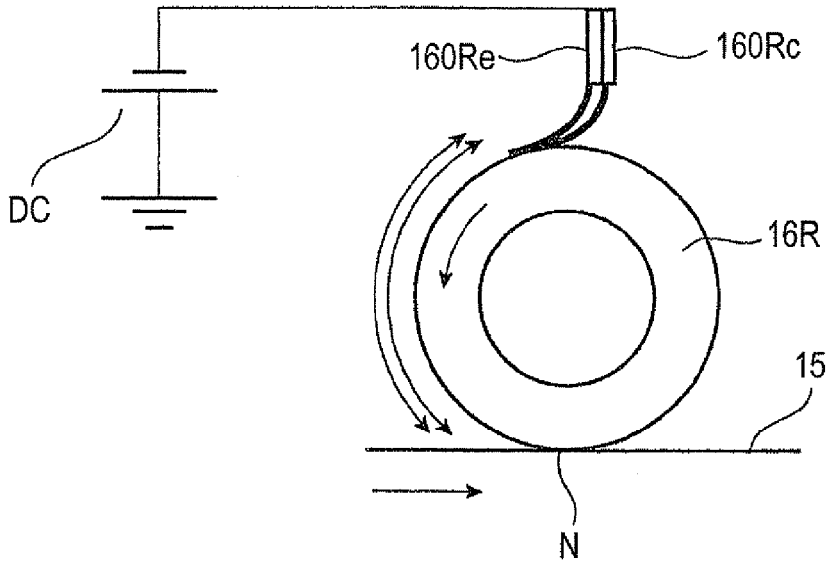
FIGS. 6A and 6B are schematic diagrams showing a modification of the charging device according to the first embodiment.
Figure 6B:
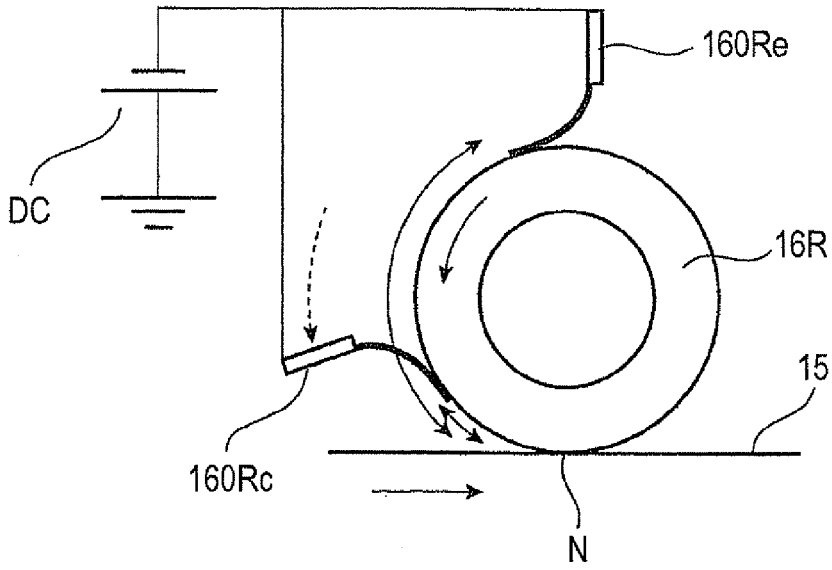

For example, FIGS. 6A and 6B schematically show a modification of the charging device 16 according to the first embodiment. In the initial state, the voltage application brush 160 is located at a position that is distant from the nip region N (see FIG. 6A). The central brush portion 160Rc is used as a movable brush portion and is moved closer to the nip region N as the number of image-formed sheets increases (see FIG. 6B). In this modification, the central brush portion 160Rc which is part of the confronting potential varying unit is moved closer to the nip region N according to the number of image-formed sheets, whereby the nip region potential of the charging roll 16R that is determined by the voltage applied by the central brush portion 160Rc becomes higher than the nip region potential of the charging roll 16R that is determined by the voltage applied by the both end brush portions 160Re and an electric field that is equivalent to strengthened electric fields that develop in the accelerated wear regions (both end regions) Re can be formed in the steady wear region Rc.

Figure 7A:
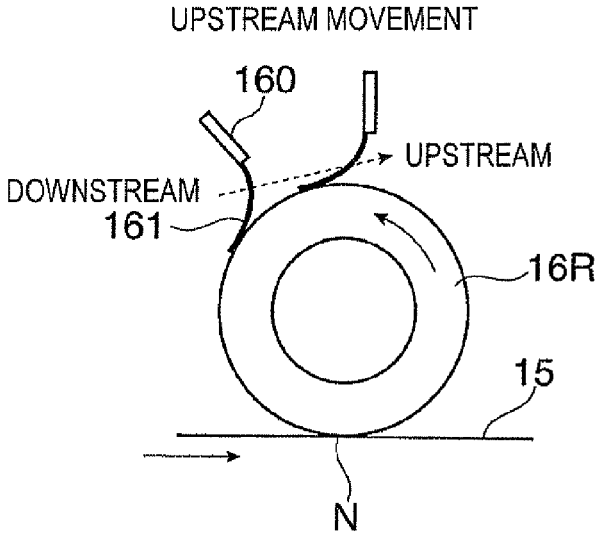
FIGS. 7A-7C are schematic diagrams showing movement directions of a movable brush portion used in the first embodiment.
Figure 7B:
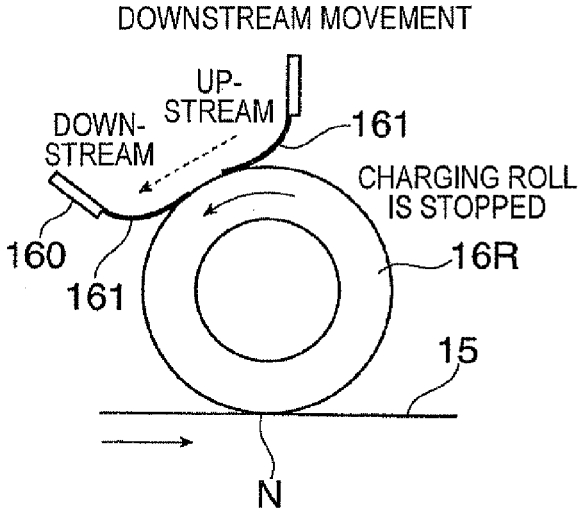
Figure 7C:
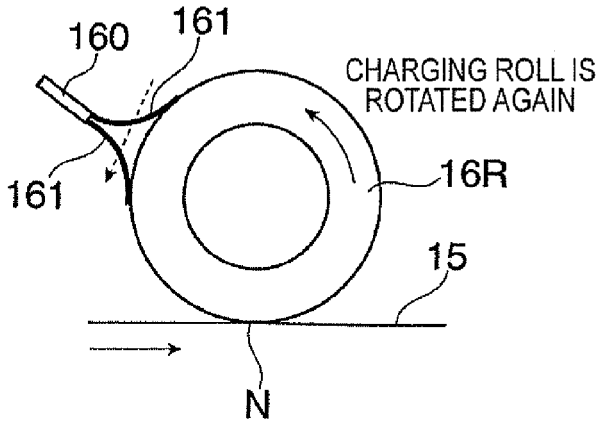

However, where the movement direction of the movable brush portion is set the same as the rotation direction of the charging roll 16R (i.e., the movable brush portion is moved downstream in the rotation direction of the charging roll 16R as in the case of the modification of FIGS. 6A and 6B), as schematically shown in FIG. 7B the inclination direction of the tip brush hair 161 is reversed when the movable brush portion is moved in a state that the charging roll 16R is stopped. As schematically shown in FIG. 7C, the inclination direction of the tip brush hair 161 is reversed again (i.e., returned to the original direction) when the charging roll 16R is rotated. As a result, the tip brush hair 161 of the movable brush portion may be entangled and hardened to likely damage (e.g., form a scratch or the like on) the surface of the charging roll 16R when moved relative to the charging roll 16R while being in contact with it. Therefore, it is preferable that the movable brush portion be moved upstream in the rotation direction of the charging roll 16R (i.e., the movement direction of the movable brush portion be set opposite to the rotation direction of the charging roll 16R).

FIGS. 8A and 8B and FIGS. 9A and 9B show results of experiments in which how the film thickness profile and the potential profile of the photoreceptor drum 15 in its axial direction vary according to the number of image-formed sheets were checked for the above-configured charging device 16 according to the first embodiment and a conventional charging device that is not provided with the confronting potential varying unit.

Figure 8A:
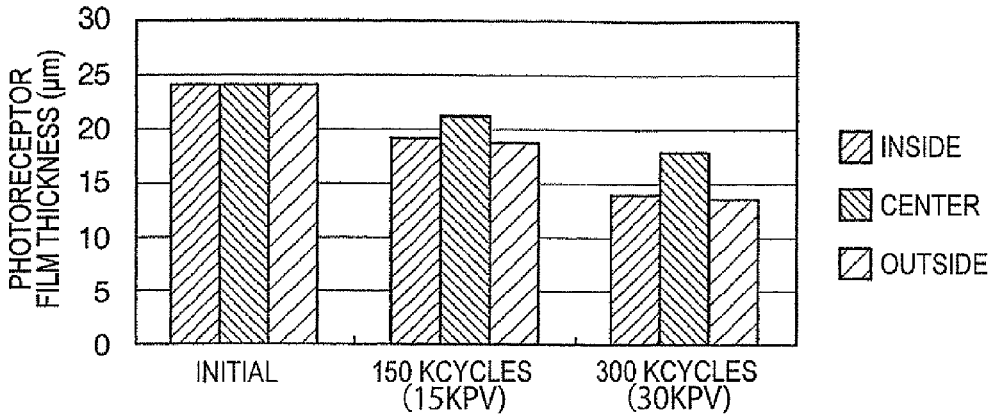
FIGS. 8A and 8B show results of experiments in which how the film thickness profile of a photoreceptor drum in its axial direction varies according to the number of image-formed sheets was checked for the image forming apparatus according to the first embodiment and a conventional image forming apparatus.

As seen from FIG. 8A, in the image forming apparatus which employs the conventional charging device, in the initial state, the film thickness of the photoreceptor drum 15 was constant (about 24 μm) in the axial direction. After image formation was performed on 15,000 sheets, the film thickness was about 21 μm at the center and about 19 μm at both ends in the axial direction. It is seen that the wear was accelerated locally (film thickness variation: about 2 μm). After image formation was performed on 30,000 sheets, the film thickness was about 18 μm at the center and about 14 μm at both ends in the axial direction. It is seen that the wear was further accelerated locally (film thickness variation: about 4 μm). This is explained as follows. As the surface layer (photoreceptor layer) of the photoreceptor drum 15 wears, the ratio of the film thickness of the photoreceptor layer to the length of the very small air gap in the nip region and its vicinity is varied and, as a result, the partial voltage across the air gap is increased and the electric field is strengthened there. The wear is thus accelerated.

Figure 8B:
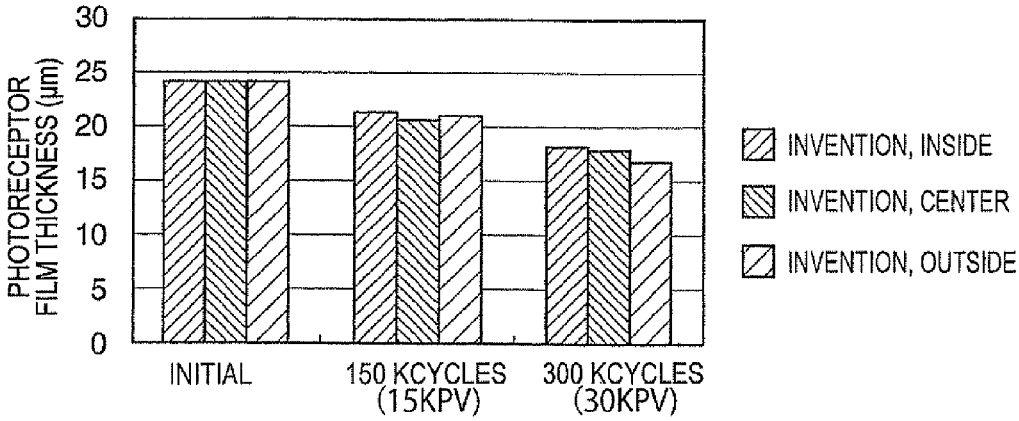

In contrast, in the image forming apparatus which employs the charging device 16 according to the first embodiment, as seen from FIG. 8B, in the initial state, the film thickness of the photoreceptor drum 15 was constant (about 24 μm) in the axial direction. After image formation was performed on 15,000 sheets, the film thickness was about 21 μm at the center and about 22 μm at both ends in the axial direction (film thickness variation: about 1 μm). It is seen that the film thickness variation in the axial direction was reduced. After image formation was performed on 30,000 sheets, the film thickness was about 18 μm at the center and about 17 to 18 μm at both ends in the axial direction. It is seen that the film thickness variation in the axial direction was kept reduced (locally accelerated wear was prevented) even with further increase in the number of image-formed sheets.

Figure 9A:
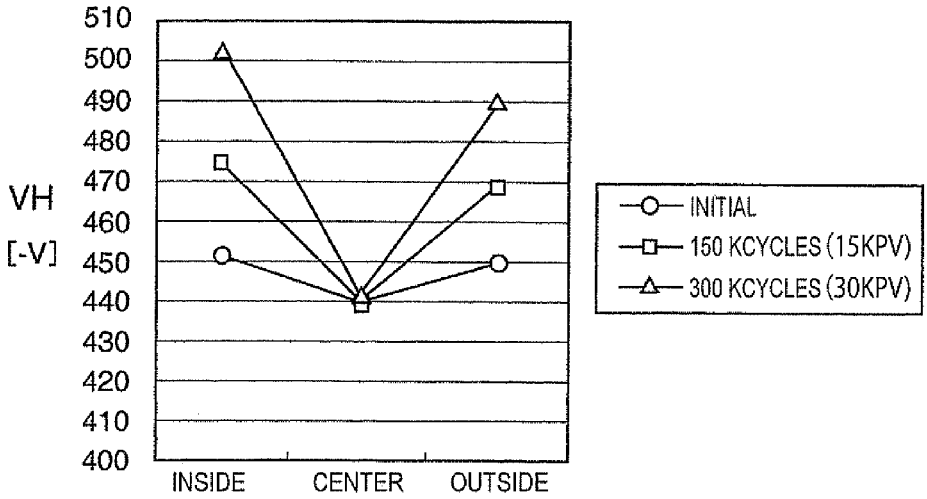
FIGS. 9A and 9B show results of experiments in which how the potential profile of the photoreceptor drum in its axial direction varies according to the number of image-formed sheets were checked for the image forming apparatus according to the first embodiment and a conventional image forming apparatus.

As seen from FIG. 9A, in the image forming apparatus which employs the conventional charging device, in the initial state, the potential of the photoreceptor drum 15 was approximately constant (about −440 to −450 V) in the axial direction. After image formation was performed on 15,000 sheets, the potential was about −440 V at the center and −470 to −475 V at both ends in the axial direction. After image formation was performed on 30,000 sheets, whereas the potential was kept at about −440 V at the center, the potential was further increased (in absolute value) to −490 to −500 V at both ends in the axial direction.

Figure 9B:
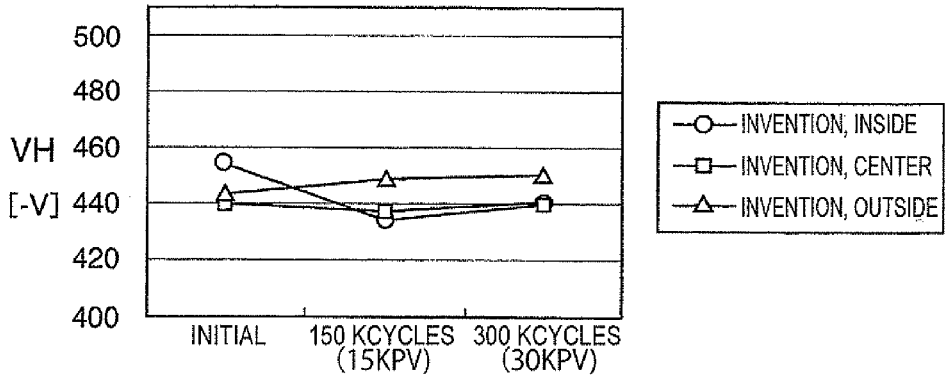

In contrast, in the image forming apparatus which employs the charging device 16 according to the first embodiment, as seen from FIG. 9B, the potential of the photoreceptor drum 15 was approximately constant (about −440 to −455 V) in the axial direction in the entire range of the number of image-formed sheets (0 to 30,000).

The configuration of a charging device according to a second embodiment will be described with reference to FIGS. 10A-10E. FIGS. 10A-10E are schematic diagrams showing the configuration of the charging device according to the second embodiment.

Whereas the charging device 16 according to the first embodiment is such that the both end brush portions 160Re corresponding to the accelerated wear regions Re are moved on the outer surface of the charging roll 16R according to the number of image-formed sheets, in the charging device 16' according to the second embodiment plural voltage application members 165*a*, 165*b*, 165*c*, . . . are disposed around the charging roll 16R. Members having, in the first embodiment, corresponding members having the same functions will be given the same reference symbols as the latter and will not be described in detail.

Figure 10A:
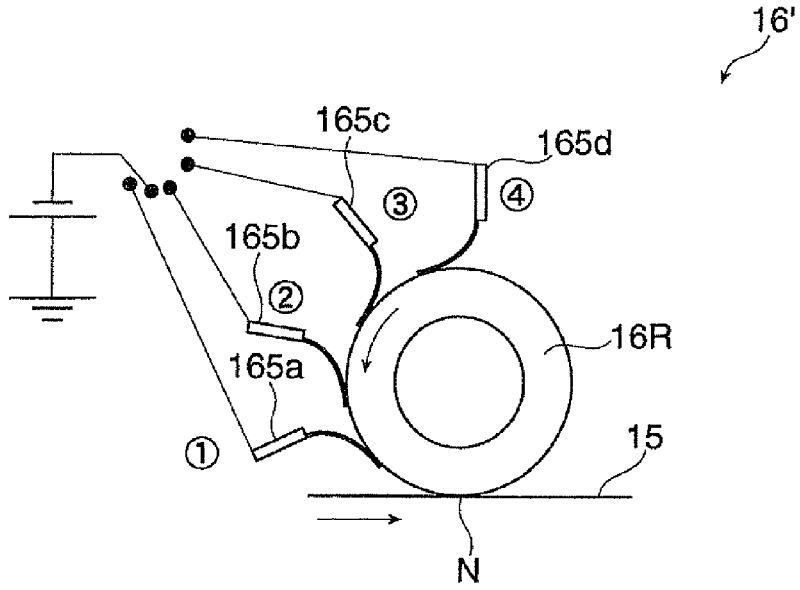
FIGS. 10A-10E are schematic diagrams showing the configuration of a charging device according to a second embodiment.

As schematically shown in FIG. 10A, the charging device 16' according to the second embodiment is equipped with the plural brush members 165*a*, 165*b*, 165*c*, . . . which are arranged parallel with the outer circumferential surface of the charging roll 16R. As schematically shown in FIGS. 10B-10E, each of the brush members 165*a*, 165*b*, 165*c*, . . . is formed in such a manner that its brush hair 166 becomes longer as the position comes closer to the center. And the ratio of the length of brush hair 166Rc of a central brush portion 165Rc to that of brush hair 166Re of both end brush portions 165Re increases as the brush member is more distant from the nip region N.

Figure 10B:
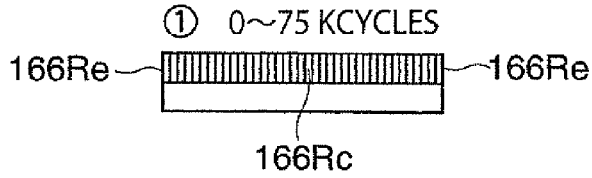
Figure 10C:
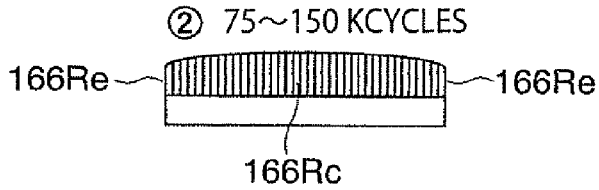
Figure 10D:
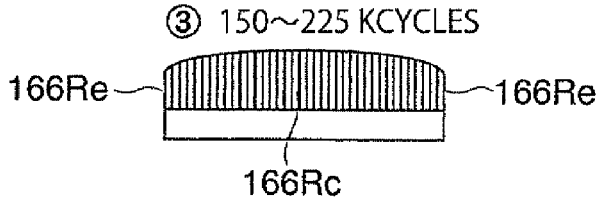
Figure 10E:
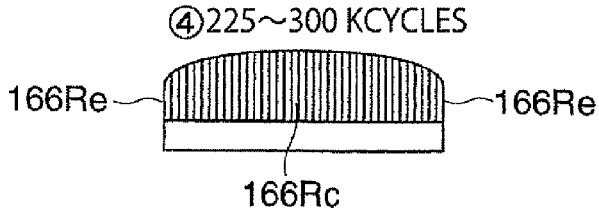

More specifically, as shown in FIG. 10B, in the brush member 166*a* which is closest to the nip region N, the length of the brush hair 166Rc of the central brush portion 165Rc is the same as that of the brush hair 166Re of the both end brush portions 165Re. And the brush members 165*b*-165*d* are configured in such a manner that the ratio r of the length of the central brush hair 166Rc to that of the both end brush hair 166Re increases as the position of the brush member goes away from the nip region N. That is, the shapes (length profiles) of the brush hair members 166 of the brush members 165*a*, 165*b*, 165*c*, and 165*d* are set so that the ratio r increases in this order.

As schematically shown in FIG. 10A, a confronting potential varying unit according to the embodiment is realized by sequentially connecting a single direct-current voltage source direct-current to the brush members 165*a*, 165*b*, 165*c*, and 165*d* in this order according the number of image-formed sheets.

In the above-configured charging device 16' according to the embodiment, as schematically shown in FIG. 7C, the tip of the brush hair 166 of each brush member 165 comes to be located on the downstream side (in the example being discussed, on the side of the nip region N) as the charging roll 16R is rotated. And the ratio of the length of the brush hair 166Rc corresponding to the steady wear region Rc to that of the brush hair 166Re corresponding to the accelerated wear regions (in the example being discussed, both end regions) Re increases as the position of the brush member goes away from the nip region N. Therefore, the nip region surface potential of the portions of the charging roll 16R that correspond to the accelerated wear regions Re can be made lower than that of the portion of the charging roll 16R that corresponds to the steady wear region Rc by the confronting potential varying unit's switching the effective brush member 165 to the adjacent brush member 165 that is more distant from the nip region N as the number of image-formed sheets increases.

Furthermore, in the charging device 16' according to the embodiment, the effective voltage application brush 165 is switched to a new voltage application brush 165 as the number of image-formed sheets increases. This prevents deterioration in charging performance due to stain or the like that is stuck to the voltage application brush 165.

The technical scope of the invention is not limited to the above embodiments, and various changes and improvements are possible without departing from the spirit and scope of the invention as described in the claims. For example, although in each embodiment the voltage application member is a brush member having conductive brush hair as a tip portion, a conductive film member may be used in place of the brush member from the viewpoint of preventing a phenomenon that hardened brush hair damages the surface of the charging roll 16R. In each embodiment, the accelerated wear regions Re are both end regions in the axial direction and the steady wear region Rc is the region between both end regions. However, where accelerated wear occurs in a different region depending on, for example, the attachment position (in the axial direction) of pressing members for pressing the charging roll 16R against the photoreceptor drum 15 (e.g., accelerated wear occurs in a central region), that region may be set as the above-described accelerated wear region Re (the other regions are set as the above-described steady wear regions Rc). The accelerated wear region voltage application portion and the steady wear region voltage application portions are provided so as to correspond to the thus-set accelerated wear region Re and steady wear regions Rc, respectively.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging device comprising:

a charging roll that is disposed so as to be in contact with an image holding body on whose surface an electrostatic latent image is to be formed, and that charges the image holding body;

a voltage application member that is disposed so as to be in contact with the charging roll, and that applies a voltage to a surface of the charging roll; and a confronting potential varying unit that varies a surface potential profile of the charging roll in an axial direction of the charging roll in a contact region where the charging roll is in contact with the image holding body according to both the number of image-formed sheets and a wear situation of the image holding body so that a surface potential of the image holding body becomes approximately constant in an axial direction of the image holding body.

2. The charging device according to claim 1, wherein the confronting potential varying unit makes a surface potential of a portion of the charging roll which is opposed to an accelerated wear region of the image holding body lower than a surface potential of a portion of the charging roll which is opposed to a steady wear region of the image holding body according to the wear situation of the image holding body in the axial direction of the image holding body.

3. The charging device according to claim 2, wherein a plurality of voltage application members is arranged around a circumferential surface of the charging roll, each voltage application member is a brush member having conductive brush hair as a tip portion, a ratio of a length of a portion of the brush hair which corresponds to the steady wear region to a length of a portion of the brush hair which corresponds to the accelerated wear region increases as a distance between the voltage application member and the contact region where the charging roll is in contact with the image holding body increases, and the confronting potential varying unit sequentially switches between the plurality of voltage application members upstream in a rotation direction of the charging roll as the number of image-formed sheets increases.

4. The charging device according to claim 1, wherein the voltage application member includes a conductive film member.

5. The charging device according to claim 1, wherein the voltage application member is applied with a direct-current voltage.

6. The charging device according to claim 5, wherein the voltage application member is applied with the direct-current voltage from a single voltage source.

7. The charging device according to claim 1, further comprising:

a cleaning roll that is disposed upstream of the voltage application member in a rotation direction of the charging roll so as to be in contact with the charging roll, and that is configured in such a manner that a sponge is wound spirally on a rotary shaft.

8. An image forming apparatus comprising the charging device according to claim 1.

9. A charging device comprising:

a charging roll that is disposed so as to be in contact with an image holding body on whose surface an electrostatic latent image is to be formed, and that charges the image holding body; and a voltage application member that is disposed so as to be in contact with the charging roll, and that applies a voltage to a surface of the charging roll, wherein the voltage application member is divided in an axial direction of the voltage application member into (i) a steady wear region voltage application portion for applying a voltage to a surface of a portion of the charging roll which is opposed to a steady wear region of the image holding body and (ii) an accelerated wear region voltage application portion for applying a voltage to a surface of a portion of the charging roll which is opposed to an accelerated wear region of the image holding body, and the voltage application member moves one of the steady wear region voltage application portion and the accelerated wear region voltage application portion along the surface of the charging roll according to the number of image-formed sheets.

10. The charging device according to claim 9, wherein each of the steady wear region voltage application portion and the accelerated wear region voltage application portion is a brush member having conductive brush hair as a tip portion, and the voltage application member moves the one of the steady wear region voltage application portion and the accelerated wear region voltage application portion upstream in a rotation direction of the charging roll as the number of image-formed sheets increases.

11. The charging device according to claim 10, wherein the accelerated wear region voltage application portion is movable brush portions which are both end portions in the axial direction of the voltage application member, the steady wear region voltage application portion is a fixed brush portion which is a central portion in the axial direction of the voltage application member, and the voltage application member moves the movable brush portions upstream in the rotation direction of the charging roll from a position which is close to a contact position where the charging roll is in contact with the image holding body as the number of image-formed sheets increases.

* * * * *